United States Patent [19]
Hunt et al.

[11] Patent Number: 4,474,673
[45] Date of Patent: Oct. 2, 1984

[54] MOLYBDENUM-CONTAINING FRICTION MODIFYING ADDITIVE FOR LUBRICATING OILS

[75] Inventors: Mack W. Hunt; Charles T. West, both of Naperville, Ill.

[73] Assignee: Standard Oil Company (Indiana), Chicago, Ill.

[21] Appl. No.: 387,641

[22] Filed: Jun. 11, 1982

[51] Int. Cl.[3] ..... C10M 1/38; C10M 1/54
[52] U.S. Cl. ..... 252/42.7; 252/46.4
[58] Field of Search ..... 252/46.4, 42.7

[56] References Cited

U.S. PATENT DOCUMENTS 2,257,750 10/1941 Lincoln et al. ..... 252/46.4
4,202,781 5/1980 Sabol et al. ..... 252/46.4
4,357,149 11/1982 West et al. ..... 252/46.4

*Primary Examiner*—Jacqueline V. Howard
*Attorney, Agent, or Firm*—James L. Wilson; William T. McClain; William H. Magidson

[57] ABSTRACT

Anti-friction additives for lubricating oil are prepared by reacting a sulfurized organic compound having an active hydrogen or potentially active hydrogen with a molybdenum halide. The resulting product has friction reducing properties at least as good as currently available phosphorus-containing additives.

16 Claims, No Drawings

MOLYBDENUM-CONTAINING FRICTION MODIFYING ADDITIVE FOR LUBRICATING OILS

FIELD OF THE INVENTION

This invention relates to new lubricating oil compositions. More specifically, it relates to a lubricating oil comprising molybdenum composition resulting from the reaction of a sulfurized organic compound having an active hydrogen or a potentially active hydrogen and a molybdenum halide.

BACKGROUND OF THE INVENTION

Molybdenum compounds are well known for improving the properties of lubricating oils for internal combustion engines. Lubricating oils containing soluble molybdenum are known for reducing friction between moving parts in internal combustion engines, thereby improving fuel economy and increasing engine life through reduced wear.

A great number of hydrocarbon-soluble molybdenum containing compositions have been disclosed in the art, including water soluble molybdenum-amine complexes, W. F. Marzluff, *Inorg. Chem.* 3, 345 (1964), molybdenum-oxazoline complexes, U.S. Pat. No. 4,176,074 Coupland, et al., and molybdenum lactone oxazoline complexes, U.S. Pat. No. 4,176,073 Ryer, et al., molybdenum beta-keto esters, molybdenum-olefin-carbonyl complexes, molybdenum-amide complexes, molybdenum diorganophosphates, U.S. Pat. No. 4,178,258 Papay, et al., molybdenum organodithiophosphates, molybdenum carboxylates, molybdenum dithiocarbamates, etc.

A series of patents issued to King and de Vries, and assigned to Chevron Research Company in 1981, disclose lubricating oil compositions incorporating antioxidant molybdenum compounds, these patents being U.S. Pat. Nos. 4,259,194, 4,259,195, 4,261,843, 4,263,152, 4,265,773, 4,272,387, 4,283,295, and 4,285,822. The inventors state that the precise molecular formula of these molybdenum compounds is not known, but they are believed to be compounds with molybdenum oxides or sulfides complexed by or the salt of one or more nitrogen atoms from a basic nitrogen-containing composition (such as e.g., succinimide, carboxylic acid amide and Mannich bases) used to prepare the lubricant. A polar promoter to facilitate the interaction between the acidic molybdenum compound and basic nitrogen compound may be used, preferably ethylene glycol or water.

U.S. Pat. No. 4,266,945, Karn, discloses a friction modifying lubricant prepared by the reaction of an acid of molybdenum or salt thereof with a phenol or aldehyde condensation production and a primary or secondary amine. The compositions are stated to be especially useful when combined with active sulfur and an oil-soluble dispersant. In U.S. Pat. No. 4,202,781, Sabol, et al., a method of preparing a molybdenum phosphosulfurized hydrocarbon composition is disclosed, the composition being useful as an oxidation inhibitor and friction modifier for lubricants of internal combustion engines. The reaction disclosed produces stable molybdenum-containing compositions without high temperatures, the use of ketone or ether-complexing solvents, or hydrogen peroxide.

U.S. Pat. No. 3,047,500, Matson, discloses what the patentees believe to be a molybdenum sulfide formed in situ as a result of the interaction of a molybdenum phenolate and an oil-soluble organic sulfur compound. These two ingredients are added to a lubricant for extreme pressure protection, there being no chemical interaction between the molybdenum and sulfur until substantial heat has been generated on the worked surfaces to produce the molybdenum sulfide.

The molybdenum compounds produced by the methods of the above-noted patents, all of which are expressly incorporated by reference herein, potentially suffer from either economic inefficiencies or from changing product requirements. For instance, the additive of the Sabol, et al. patent has found widespread commercial acceptance as a friction reducing component of lubricating oils. Unfortunately, it contains phosphorus, a component which, when introduced into an automobile exhaust system, can adversely affect the efficiency of various air pollution control devices, such as, for instance, catalytic convertors and oxygen sensors. For this reason, at least one major U.S. automobile manufacturer has specified a maximum level of 0.11% phosphorus in motor oils for 1983 and thereafter. The most effective anti-wear component in most oil additive packages is zinc dithiophosphate, and at current levels of incorporation in motor oils, would effectively use up the entire phosphorus "allotment." Therefore, there is an urgent need for a commercially acceptable molybdenum additive which is an effective friction-reducing agent in motor oil without the use of phosphorus.

SUMMARY OF THE INVENTION

The lubricating oil anti-friction additive composition of the present invention can be prepared by reacting a sulfurized organic compound having an active hydrogen or potentially active hydrogen with a molybdenum halide. The molybdenum halide is preferably molybdenum pentachloride, and the sulfurized organic compound can comprise the sulfurized form of, for instance, alcohols, carboxylic acids (including fatty acids and fatty acid esters), phenolic compounds and tall oils from wood pulping processes, and the salts thereof. The reaction can take place in the presence of diluent oil and/or solvent, such as xylene or hexane.

DETAILED DESCRIPTION OF THE INVENTION

A general object of this invention is to provide improved phosphorus-free oil-soluble molybdenum-containing anti-friction agents and lubricating oil compositions comprising these agents.

We have now found that the objects of this invention can be obtained with a molybdenum additive comprising the reaction product of a sulfurized organic compound having an active hydrogen or potentially active hydrogen and molybdenum halide.

In addition to its use as a lubricating oil additive, the molybdenum compounds of the present invention can find utility in certain self-lubricating or wear-resistant structures, in fuel additives, as mold release agents, and in iron and steel alloys.

While the organic compounds disclosed herein might be expected to function as friction reduction agents under reaction conditions without being first sulfurized, the sulfurized form of the compound is critical to attain the anti-friction performance of the present invention. It is well known that improved anti-friction properties result from molybdenum-sulfur complexes, as opposed to molybdenum compounds only (see, for example, U.S.

Pat. No. 3,047,500, Matson). The molybdenum halides exhibit very high reactivity, permitting faster and more efficient reactions than is possible with other molybdenum compounds.

It is to be understood that by "active hydrogen" as used herein, it is meant a hydrogen which is easily surrendered by the molecule under reaction conditions. As used herein, for example, alcohols, phenols, and carboxylic acids, having an —OH group, and thiols, having an —SH group, all contain "active hydrogens." Esters and salts of organic acids contain potentially active hydrogen groups or atoms.

Briefly, the molybdenum-containing compositions of this invention are produced by contacting molybdenum halide with a sulfurized organic compound in the presence of heat, and thereafter stripping any evolved gases therefrom with an inert gas.

Molybdenum compounds useful in preparing the novel lubricating oil additives of this invention are those molybdenum halides which readily react with an active hydrogen or potentially active hydrogen in a sulfurized organic compound, liberating the hydrogen to combine with the halide. Molybdenum fluorides, chlorides, bromides and iodides, but particularly molybdenum pentachloride, can be utilized herein.

The organics useful in the invention are those having a molecular weight high enough to exhibit oil solubility and containing an active hydrogen which reacts with the halide of the molybdenum halide compound. The organics of the present invention are sulfurized, having been reacted with a sulfur-containing compound such as elemental sulfur, sulfuryl chloride or hydrogen sulfide under elevated temperatures. The sulfur can comprise from about 0.5% to 12.0% by weight of the sulfurized organic compound. Preferably, about 5–8%, and most preferably about 6.5% sulfur, by weight, is incorporated.

One class of organic compounds useful in this invention is carboxylic acids, such as fatty acids and acid esters. Both saturated and unsaturated fatty acids and esters can be used, although the unsaturated acids are preferred because it is possible to incorporate more sulfur therein due to the unsaturation. Exemplary fatty acids include oleic, linoleic, linolenic, stearic, plamitic, lauric, palmitoleic, recinoleic, petroselinic, vaccenic, oleostearic, licanic, paranaric and tartaric, when sulfurized, can be used in the present invention. Other aliphatic carboxylic acids useful herein include pelargonic acid and myristic acid. Aromatic fatty acids, such as phenylstearic acid, can also be used.

Another class of organic compounds useful herein comprises hydroxy compounds, such as alcohols, including monohydric compounds such as cyclohexanol, furfuryl alcohol and steroid alcohols. Also of use are the phenolic compounds, such as benzophenol, cresol, xylenol, resorcinol and naphthol. Phenolics are some what less reactive toward sulfur than the unsaturated compounds noted above unless activated by forming a phenolate salt. Alternatively, a very active sulfur, such as sulfuryl chloride, can be used to sulfurize the phenolics.

Sulfur substituted alcohols and phenolics (thiols and thiophenols) can serve as suitable organic compounds herein. Tall oils, being a mixture of rosin acids, fatty acids and other materials, obtained by acid treatment of spent black liquor from wood pulping, can also be utilized as an organic compound in the present invention.

Preferably, a phenolic compound having a molecular weight of from 100 to 2000 in an aliphatic side chain, and preferably from 200 to 600 is used for purposes of economy and ease of handling. Phenolics are the preferred form of organic in this invention because of their known multifunctional properties in lubricating oils, including antioxidation and detergency characteristics. Specific phenolic compounds include dodecyl phenol, nonylphenol, polypropyl phenols and polybutyl phenol.

The salts of the organic compounds disclosed above, particularly the salts of $Li^+$, $Na^+$, $K^+$ and $NH_4^+$, and various divalent salts of, for instance, $Mg^{++}$ and $Ca^{++}$, can be expected to react favorably under reaction conditions due to their very basic nature.

The molybdenum molecule can be incorporated into the organic compound in one of two ways: firstly, the organic can be mixed with a solvent, such as xylene or hexane, and the molybdenum halide thereafter added, or alternatively, the molybdenum halide can be dissolved in the solvent and thereafter added to the organic. While a solvent is not necessary to produce the reaction product herein, most molybdenum halides are soluble in aliphatic or aromatic solvents having from 6 to 8 carbon atoms, which may therefor function as a control mechanism for the reaction. The solvent used is largely immaterial so long as it is substantially chemically inert and does not act as a reactant in the process, and the molybdenum halide is soluble in it. It should have a boiling point low enough to be easily removed through application of heat.

The reaction between the molybdenum halide and sulfurized organic compound proceeds at room temperature or below. However, if a solvent is used to facilitate the reaction, the solvent is preferably removed. A stripping gas (an inert gas such as nitrogen) is a convenient method of removing evaporated solvent and hydrogen halide evolved in the instant reaction.

While not necessary for the proper functioning of the reaction, water can be added to the reaction product of the invention to remove excess halide. Applicant has found that the halide content of the finished product is decreased with the addition of one mole of water per mole of halide remaining in the reaction product. Preferably, an excess of water is added to insure that all unreacted molybdenum halide is hydrolyzed. Excess water is easily removed by heating the final product above 212° F. Additionally, diluent oil, while not necessary for the functioning of the present reaction, can be added to provide the desired viscosity for ease of handling. The oil may be naphthenic or paraffinic, such as a solvent extracted 110 neutral mineral oil, preferably with a flash point of at least 200° F.

In somewhat greater detail, the sulfurized organic compound, as, for example, sulfurized dodecylphenol, has an active hydrogen, as here in the —OH group. When the sulfurized organic is reacted with the molybdenum halide, as for example, molybdenum pentachloride, the hydrogen from the hydroxyl group combines with the chlorine from molybdenum pentachloride to produce HCl gas with the molybdenum being attached to the oxygen of the phenol. While a molar ratio of less than 1 to 5 can be utilized, an —OH:$MoCl_5$ ratio of 5:1 will react with all (or as much as possible) of the chloride with hydrogen. A small quantity of chloride may remain in the organic compound-molybdenum complex or as unreacted molybdenum pentachloride. Because a relatively small amount of chloride can have potentially corrosive effects on engine parts, the reaction product is preferably hydrolyzed with a small amount of water to remove any residual chloride, a step which has little or no effect on the production of the friction-reducing compound, but which is desirable if measurable quantities of chloride are detected.

The above described reaction products of the present invention are effective additives for lubricating oil compositions when added thereto in amounts to impart about 0.01 to about 1.00 weight percent molybdenum in the finished oil and preferably from 0.02 to 0.05 weight percent molybdenum based upon the oil. Suitable lubricating base oils are mineral oils, petroleum oils, synthetic lubricating oils, and lubricating oils of animal and vegetable origin. Concentrates of the additive composition of the present invention in a suitable base oil containing about 0.3 to 30 percent by weight of the additive based upon the oil alone or in combination with other well known additives can be used in an oil-additive blend.

The invention will be more fully understood by reference to the following specific examples illustrating various modifications of the invention, which should not be construed as limiting the scope of the invention.

EXAMPLE I

A one-liter, three-necked flask equipped with mechanical mixing, temperature control, heating mantle and overhead condenser was charged with 100 grams of sulfurized dodecylphenol, 100 grams of 5W oil as a diluent, and 150 grams xylene as a solvent. This was stirred well, and 17 grams of molybdenum pentachloride were added over approximately 15 minutes by means of a powder funnel. The mixture was heated to 200° F. and stirred for 1 hour, then heated to 300° F. and hydrochloric acid and xylene were stripped with nitrogen. Ten grams of Celite 535 filtering additive were added and the resulting product filtered through a precoated Buchner filter. The resulting product contained 3.0 percent molybdenum and 0.97 percent chlorine.

EXAMPLE II

A one-liter, three-necked flask equipped as above was charged with 100 grams sulfurized dodecylphenol, 75 grams 5W oil, and 150 grams xylene. After mixing, 35 grams of molybdenum pentachloride were added over approximately 15 minutes, heated to 185° F. and stirred for 30 minutes. Then 10 grams of water were added over approximately 10 minutes, the mixture then heated to 300° F. and HCl and xylene stripped with nitrogen. The reaction product was filtered with 10 grams of Celite 535 and 2.0 grams of a Mannich dispersant were added as an HCl stabilizer or scavenger. The resulting product contained 3.2 percent molybdenum and 0.53 percent chlorine.

The sulfurized dodecylphenol of both Examples was prepared by reacting dodecylphenol with sulfurylchloride.

The reaction products of Examples I and II were blended into a 7½ W/30 lubricating oil at a concentration of from about 0.04–0.5% by weight of the oil.

As a measure of the effectiveness of a particular friction reduction molybdenum additive, motored engine tests were conducted and the horsepower lost due to friction (the "friction horsepower") was calculated as a functiion of temperature for a base line oil having no molybdenum additive, a commercially available lubricating oil having a phosphorus-containing molybdenum additive, and the reaction product of Example I. In the test, an oil additive package was placed in a thermostated engine driven by an electric motor. The engine was heated to various temperatures and the horsepower required to overcome the friction inherent in the engine was measured. The lower the horsepower, the better the additive. Table I shows that the product of the claimed process is comparable to or better than phosphorus-containing additives and baseline oils in reducing friction in the motored engine test.

TABLE I

| *Oil-containing additive of | Motored Engine Test Friction HP at oil temp (°F.) 100 | 140 | 180 | 200 | 220 | 240 | 260 |
|---|---|---|---|---|---|---|---|
| Example 1 | 11.5 | 9.85 | 9.05 | 8.80 | 8.55 | 8.70 | 9.05 |
| Phosphorous-molybdenum additive* | 11.4 | 9.90 | 9.00 | 8.75 | 8.70 | 8.75 | 8.95 |
| baseline oil | 11.5 | 9.88 | 9.15 | 8.98 | 9.30 | 9.63 | 10.20 |

*Commercially available phosphosulfurized polybutene molybdenum additive.

We claim:

1. An improved lubricating oil composition comprising a lubricating oil and the reaction product of a sulfurized organic compound containing an active hydrogen or potentially active hydrogen and molybdenum halide, said reaction product having been obtained from a reaction proceeding at a temperature within the range of a temperature below room temperature to about 300° F. and said sulfurized organic compound comprising a sulfurized alcohol, a sulfurized phenolic compound, a sulfurized thiol, or a sulfurized thiophenol.

2. The composition of claim 1 wherein the sulfurized organic compound comprises a sulfurized alcohol or a sulfurized phenolic compound.

3. The composition of claim 1 wherein the sulfurized organic compound comprises a sulfurized thiol or thiophenol.

4. The composition of claim 1 wherein the molybdenum halide comprises molybdenum pentachloride.

5. The composition of claim 1 wherein the sulfurized organic compound is a phenolic having an alkyl, aryl or alkylaryl side chain with a molecular weight of from 100 to 2000.

6. The composition of claim 5 wherein the sulfurized organic compound comprises sulfurized dodecylphenol.

7. The composition of claim 6 wherein from 0.1 to 5 moles of phenol are reacted per mole of molybdenum halide.

8. The composition of claim 7 wherein 5 moles of phenol are reacted per mole of molybdenum halide.

9. The composition of claim 1 wherein the reaction product is incorporated in a lubricating oil at a concentration of from 0.01 to 1.0% by weight of the lubricating oil.

10. The composition of claim 1 wherein the reaction product is incorporated in a lubricating oil in a concentrated additive composition comprising from 0.3 to 30% by weight of the lubricating oil.

11. The composition of claim 1 wherein the sulfurized organic compound comprises from 0.5 to 12 percent, be weight, of sulfur.

12. A process for preparing a lubricating oil composition having improved friction modifying properties comprising reacting a sulfurized organic compound containing an active hydrogen or potentially active hydrogen with a molybdenum halide at a temperature within the range of a temperature below room temperature to about 300° F. to form a reaction product, and thereafter adding the reaction product to a lubricating oil base, said sulfurized organic compound comprising a sulfurized alcohol, a sulfurized phenolic compound, a sulfurized thiol, or a sulfurized thiophenol.

13. The process of claim 12 wherein said molybdenum halide comprises molybdenum pentachloride.

14. The process of claim 12 wherein the sulfurized organic compound is a phenolic having an alkyl, aryl or alkylaryl side chain with a molecular weight of from 100 to 2000.

15. The process of claim 14 wherein the sulfurized organic compound comprises sulfurized dodecylphenol.

16. The product produced by the process of claim 12.

* * * * *

UNITED STATES PATENT OFFICE

CERTIFICATE OF CORRECTION

Patent No. 4,474,673 Dated October 2, 1984

Inventor(s) HUNT, MACK W. AND WEST, CHARLES T.

It is certified that error appears in the above-identified patent and that said Letters Patent are hereby corrected as shown below:

Column 5, line 32, "200" should be -- 220 --.

Column 5, line 58, "0.5%" should be -- 0.05% --.

Signed and Sealed this

*First* Day of *October 1985*

[SEAL]

*Attest:*

*Attesting Officer*

DONALD J. QUIGG

*Commissioner of Patents and Trademarks—Designate*